US007329104B2

(12) United States Patent
Kenney

(10) Patent No.: US 7,329,104 B2
(45) Date of Patent: Feb. 12, 2008

(54) SPLIT-HOUSING PIPETTE PUMP

(75) Inventor: James W. Kenney, Broomall, PA (US)

(73) Assignee: Drummond Scientific Company, Broomall, PA (US)

( * ) Notice: Subject to any disclaimer, the term of this patent is extended or adjusted under 35 U.S.C. 154(b) by 0 days.

(21) Appl. No.: 10/791,262

(22) Filed: Mar. 2, 2004

(65) Prior Publication Data

US 2005/0196303 A1 Sep. 8, 2005

(51) Int. Cl.
*F04B 45/047* (2006.01)
*F04B 53/22* (2006.01)

(52) U.S. Cl. ..... 417/413.1; 92/98 R

(58) Field of Classification Search ..... 417/413.1, 417/535, 537, 559; 92/98 R
See application file for complete search history.

(56) References Cited

U.S. PATENT DOCUMENTS 2,748,606 A * 6/1956 Cornelius ..... 417/413.1
3,334,545 A 8/1967 Houser
3,408,809 A 11/1968 Golden
3,416,461 A * 12/1968 McFarland ..... 92/98 R
3,539,276 A * 11/1970 Matsuura ..... 417/413.1
3,776,666 A * 12/1973 Ludwig ..... 417/413.1
4,430,048 A * 2/1984 Fritsch ..... 92/98 R
4,675,782 A 6/1987 Hibbert et al.
4,794,847 A 1/1989 Kreuter et al.
4,842,498 A * 6/1989 Bramstedt et al. ..... 417/413.1
5,192,198 A * 3/1993 Gebauer et al. ..... 92/98 R
5,232,353 A 8/1993 Grant
5,332,370 A 7/1994 Nakayama et al.
5,551,843 A * 9/1996 Hauser ..... 417/413.1
5,615,596 A 4/1997 Issa
5,619,900 A 4/1997 Kullmann et al.
5,731,763 A 3/1998 Herweck et al.
5,814,765 A 9/1998 Bauer et al.

* cited by examiner

*Primary Examiner*—Michael Koczo, Jr.
(74) *Attorney, Agent, or Firm*—Joseph M. Konieczny, Sr.

(57) ABSTRACT

A diaphragm pump with a bi-component diaphragm pump housing. The housing has a top component and a bottom component that connect along first and second complimenting connection interfaces and form an interior pump chamber, an exterior pressure port, an exterior vacuum port, and fluid communication channels connecting the exterior ports with the interior chamber. The first and second connection interfaces are oriented transverse to one another. The components of the pump are self-locking and can be assembled without the use of tools.

63 Claims, 11 Drawing Sheets

SPLIT-HOUSING PIPETTE PUMP

FIELD OF THE INVENTION

The present invention relates to a diaphragm pump that can be assembled by hand. In particular, the invention relates to a miniature diaphragm pump having a reduced number of components that can be connected without the use of tools, extraneous fasteners or adhesives.

BACKGROUND OF THE INVENTION

Miniature diaphragm pumps are well known in the prior art. Typically, known miniature diaphragm pumps are made from multiple prefabricated components that are connected using screws, adhesives, bands, and/or other fasteners. Assembly of the pump components is labor intensive and time consuming, especially when at least one hand tool is required to install the fasteners. Therefore, it would be desirable to provide a miniature diaphragm pump that can be assembled by hand from components that are self-locking.

In many miniature diaphragm pumps, the pressure and vacuum ports are oriented at a 90-degree angle relative to the axis of movement of the linearly-reciprocating diaphragm. This design typically requires at least three separate housing components that must be arranged and connected in a stacked configuration. In order to reduce the cost and amount of time to assemble a pump having the aforementioned pressure and vacuum port orientation, it would be desirable to provide a housing that is made of only two prefabricated components that must be arranged and connected.

SUMMARY OF THE INVENTION

The present invention provides a miniature diaphragm pump that can be assembled by hand from components that are self-locking. As a result, the cost and amount of time required to assemble the diaphragm pump is reduced compared to known miniature diaphragm pumps.

The housing of the pump is made of only two components. The bi-component housing has a top component and a bottom component that connect along first and second complimenting connection interfaces, and form an interior pump chamber, an exterior pressure port, an exterior vacuum port, and fluid communication channels connecting the exterior ports with the interior chamber. Preferably, the first and second connection interfaces are inclined relative to one another. In a preferred embodiment, the first and second connection interfaces of the bottom component are oriented at an obtuse angle, and the first and second connection interfaces of the top component are arranged at an angle greater than 180 degrees.

Each of the bottom and top components has a plurality of exterior surfaces that form the exterior of the housing. The bottom component has a base. A valve block is formed on one end of the base. A first connection interface and diaphragm seat are formed at the other end of the base. The valve block includes opposed exterior side surfaces, an exterior rear surface, and a second interior connection interface. The pressure and vacuum ports are formed on the exterior rear surface of the valve block. Channels extend through the valve block from the pressure port and vacuum port, respectively, to the second connection interface.

The top component has a base. An interior cavity and a first connection interface are formed at one end of the base. A valve head is formed at the other end of the base. The valve head includes a second connection interface. Channels extend through the valve block from the second connection interface to the interior cavity. The channels of the top and bottom components align and form the fluid communication channels of the housing when the first component and second component are connected.

The pump includes means for self-locking the top component to the bottom component with the first interior interfaces and the second interior interfaces in contact with one another. The self-locking means creates a compressive force on both connection interfaces of the top and bottom components. In a preferred embodiment, the self-locking means comprises a housing cover. The housing cover slidably engages and clamps together the top and bottom components. The cover has opposed, interior edges that engage the exterior surfaces of the top and bottom component. The edges comprise tapered grooves on the interior of the cover that slidably engage the elongate exterior edges of the top and bottom components. In a preferred embodiment, the cover includes a snap-lock that engages the bottom component. In one embodiment, the snap lock comprises a detent protruding from an exterior side surface of the first component that cooperatively engages a notch in the cover.

In another embodiment, the self-locking means comprises clips that clamp the top and bottom component together. In another embodiment, the self locking means comprises interlocking tabs and slots that are integrally formed on the top and bottom components, respectively.

The diaphragm pump includes a motor having a rotating output shaft, and a linearly oscillating diaphragm mounted inside the housing and connected to the pump shaft. The housing includes means for self-locking the motor to the housing. In a preferred embodiment, the bottom component includes a pump mount adapted to connect the pump motor to the bottom component. The pump mount is integrally formed with the bottom component. In one embodiment, the pump mount comprises a pair of elastically-deformable, U-shaped mounts on the bottom component.

DETAILED DESCRIPTION OF PREFERRED EMBODIMENTS

Figure 1:
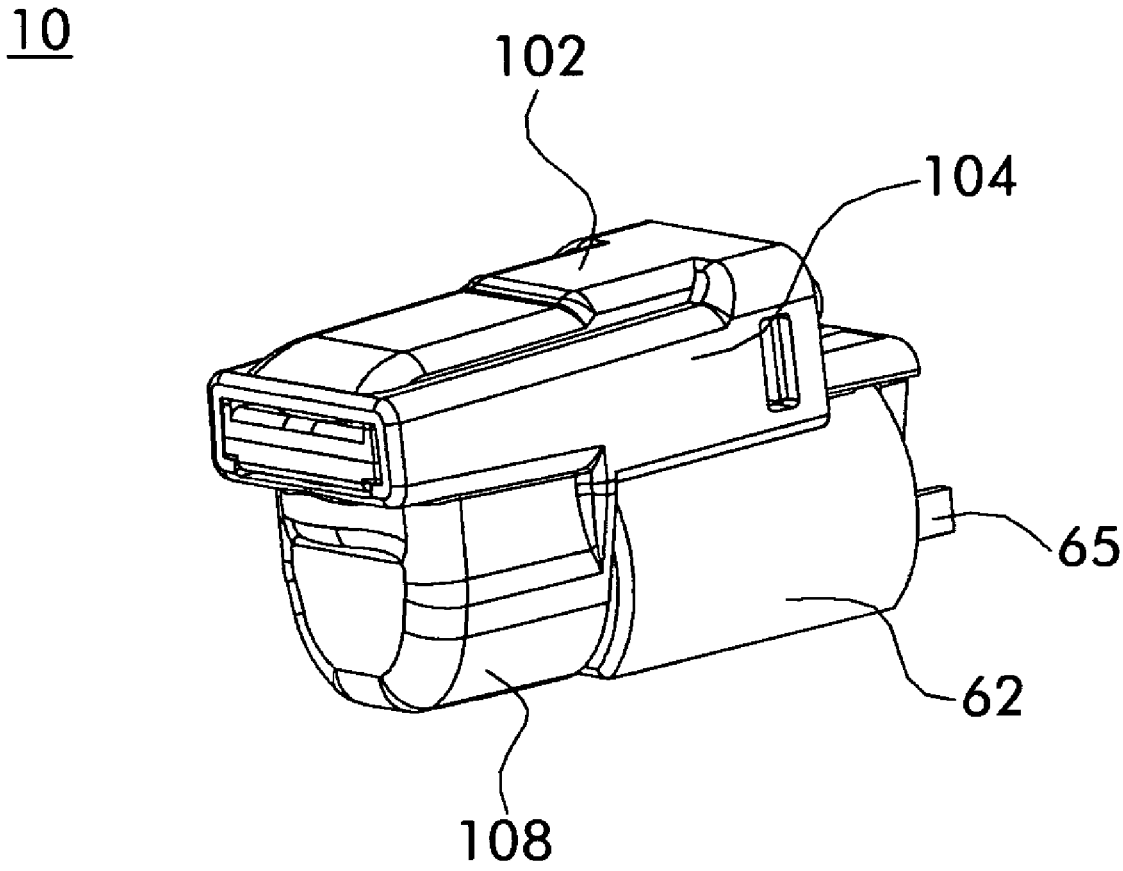
FIG. 1 is a first perspective view of a diaphragm pump in accordance with an embodiment of the invention.

The diaphragm pump of the present invention is described below with reference to FIGS. 1-18, wherein like reference numerals are used throughout to designate like elements. As used herein, the term "hand assembled" shall mean capable of being assembled by hand without the use of tools of any kind. As used herein, the term "self-locking" as applied to components shall mean that the components are capable of engaging and locking to one another without the use of extraneous fasteners, adhesives or other components.

A diaphragm pump in accordance with a preferred embodiment of the present invention is designated generally by reference numeral 10. In the preferred embodiment, the pump 10 can be hand assembled from components that are self-locking.

Figure 3:
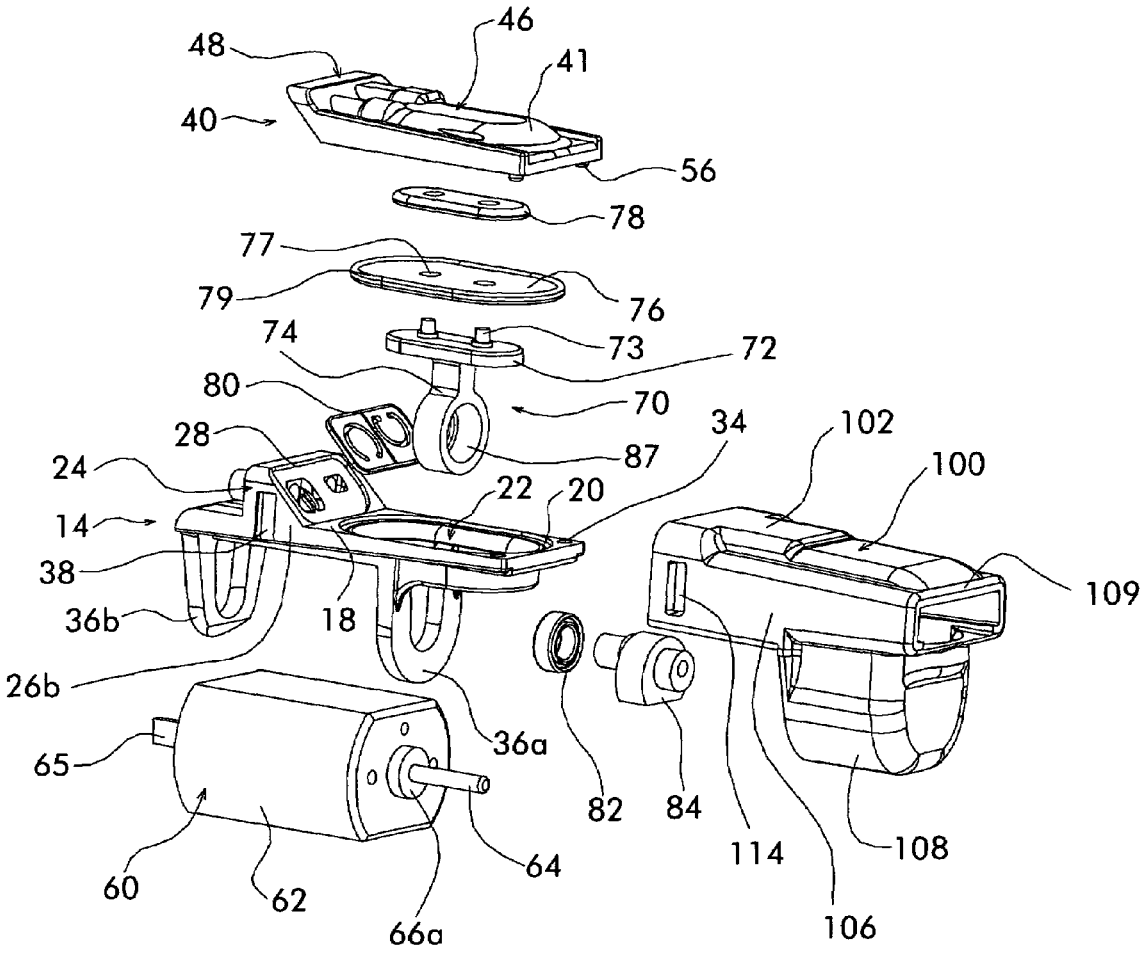
FIGS. 3 and 4 are exploded perspective views of the diaphragm pump shown in FIG. 1.
Figure 4:
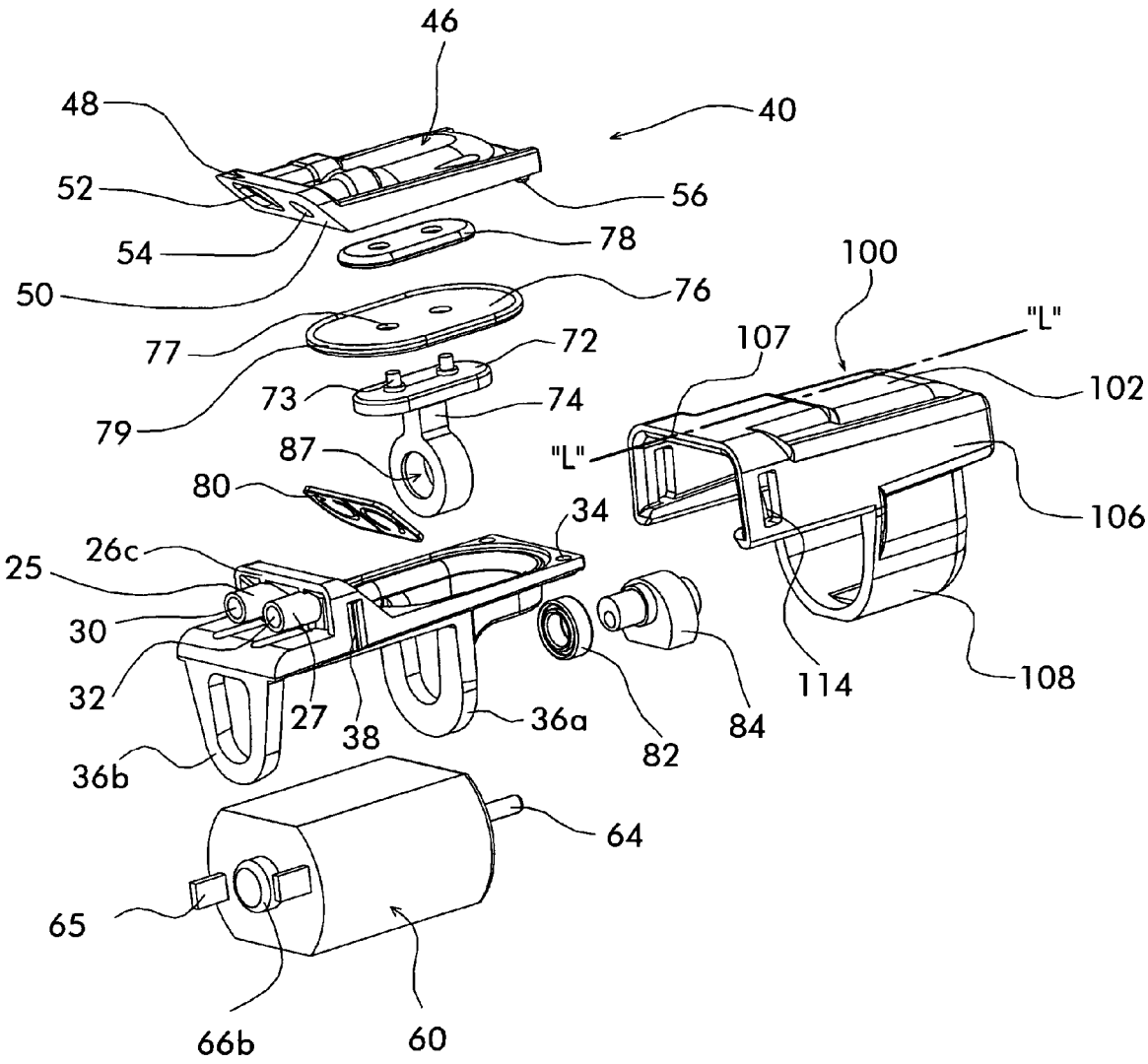

Referring to FIGS. 3 and 4, the pump 10 has a bi-component housing comprising a bottom or first component 14 and top or second component 40. The bottom 14 and top 40 components connect along first and second complimenting connection interfaces and form an interior pump chamber, an exterior vacuum port 25, an exterior pressure port 27, and fluid communication channels connecting the exterior ports 25, 27 with the interior chamber. In one embodiment, the pressure port 25 and vacuum port 27 have parallel and coplanar lengthwise extending axes.

Preferably, the top housing component 40 is made by injection molding and is formed as a single, integrated part. Similarly, the bottom housing component 14 is preferably made by injection molding and is formed as a single, integrated part. The housing components 14, 40 are preferably manufactured from an injection moldable material that is resistant to chemical attack. The material from which the bottom component 14 is made is also preferably elastically deformable so that the U-shaped motor mounts 36, described below, can be deflected during installation of the motor 60. For example, the top and bottom components 40,14 may be made of polypropylene.

The bottom component 14 has a generally rectangular, planar base. Referring to the orientation shown in FIGS. 3 and 4, a bottomless cavity 22 and a first interior connection interface 18 are formed on one end of the top side of the base. A valve block 24 is formed on the other end of the top side of the base. A pair of opposed U-shaped motor mounts 36*a*,36*b* extends from the bottom side of the base. A pair of alignment bores 34 is formed in the first interior connection interface 18.

The first interior connection interface 18 is generally co-planar with the base and extends around the perimeter of the bottomless cavity 22. A recessed diaphragm seat 20 is formed on the perimeter of the cavity 22. An elastic diaphragm 76 sits in the diaphragm seat 20 and reciprocates within the cavity 22.

Figure 5:
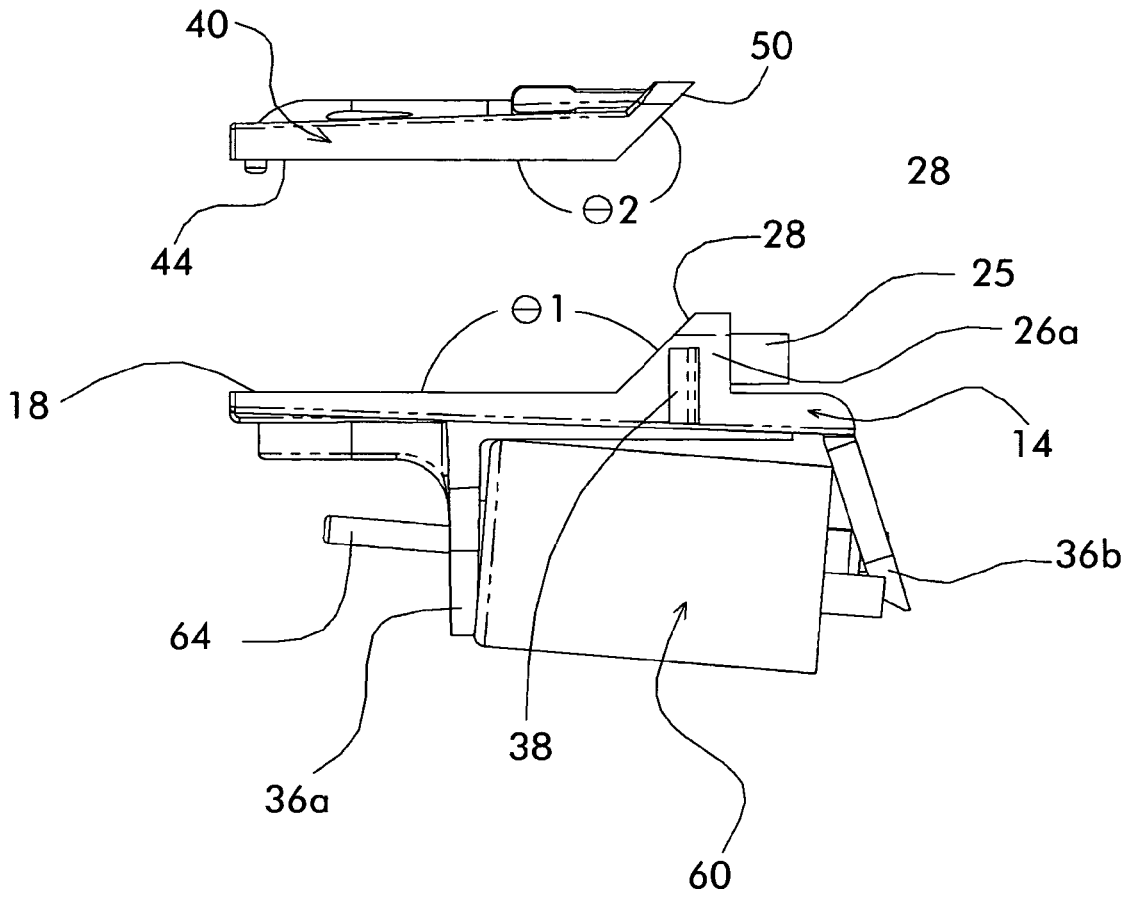
FIG. 5 is a side elevational view of the motor being installed on the bottom component of the diaphragm pump shown in FIG. 1.

The valve block 24 is preferably integrally formed with the base of the bottom component 14. The exterior surface of the valve block 24 includes opposed side surfaces 26*a*, 26*b* and a rear surface 26*c*. The valve block 24 has a second interior connection interface 28 that is contiguous with the first interior connection interface 18, but is oriented upwardly and inclined at an angle θ1 relative the first interior connection interface 18 as shown in FIG. 5. In a preferred embodiment, the angle θ1 is approximately 135 degrees. The angle θ1 may be increased or decreased. However, reducing the angle θ1 to a value between 90 degrees and 135 degrees increases the profile or height of the pump, while increasing the angle θ1 make the components more difficult to manufacture and adversely effects the performance of the valves described below.

Referring to FIG. 4, a vacuum port 25 and pressure port 27 are formed on the rear surface 26*c* of the valve block 24. An intake channel 30 and an exhaust channel 32 extend through the valve block 24 from the exterior rear surface 26*c* to the recessed portion 28*a* of the second interior connection interface 28. A detent 38 extends outwardly from each of the exterior side surfaces 26*a*, 26*b*.

Figure 10:
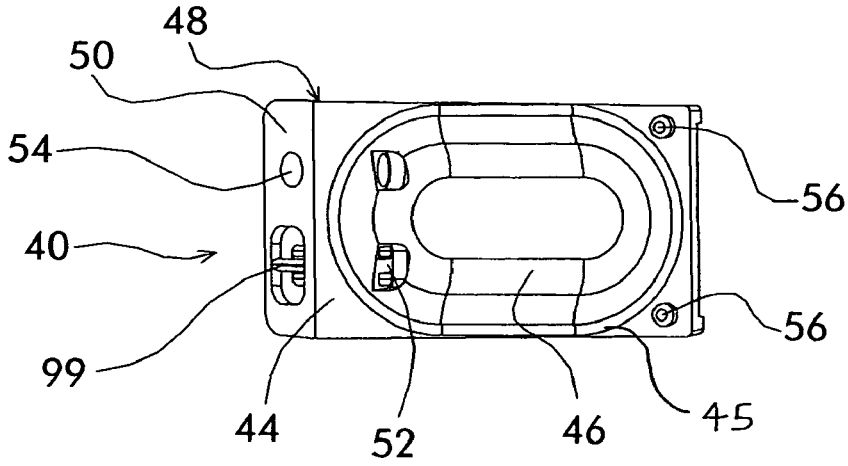
FIG. 10 is a bottom plan view of the top component shown in FIG. 3.
Figure 11:
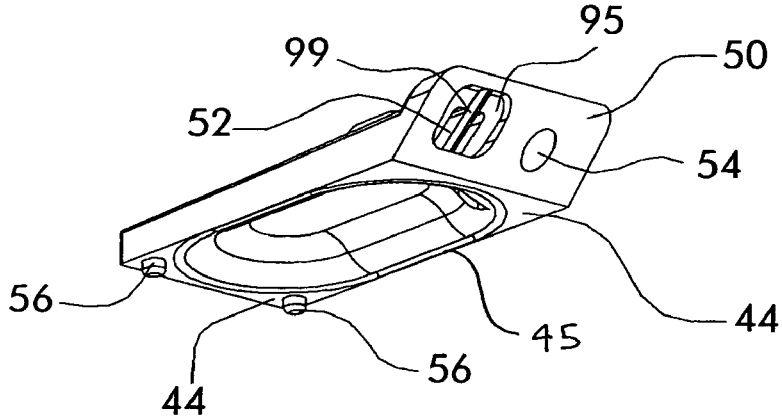
FIG. 11 is a perspective view of the top component shown in FIG. 3.

The top component 40 also has a generally rectangular, planar base. As best seen in FIGS. 10 and 11, and referring to the orientation shown therein, the top component has a concave cap portion 46 formed in one end of the bottom surface. The cap portion 46 defines the upper boundary of the interior diaphragm chamber. A first interior connection interface 44 extends around the perimeter of the cap portion 46 and is generally co-planar with the base. A recessed diaphragm seat 45 is formed on the perimeter of the cavity cap portion 46. An elastic diaphragm 76 sits in the diaphragm seat 45 and reciprocates within the cap portion 46.

A valve head 48 is integrally formed at the other end of the top component 40. The valve head 48 has a second interior connection interface 50, which is contiguous with the first interior connection interface 44, but which is inclined at an angle θ2 relative to the plane of the first interior connection interface 44. In a preferred embodiment, the angle θ2 is preferably about 225 degrees as seen in FIG. 5. The angle θ2 may be increased or decreased. However, increasing the angle θ2 to a value between 135 degrees and 270 degrees increases the profile or height of the pump, while decreasing the angle θ2 make the components more difficult to manufacture and adversely effects the performance of the valves described below. An intake channel 52 and an exhaust channel 54 extend through the valve head 48 from the second interior connection interface 44 to the inside of the cap portion 46.

Referring to FIGS. 10 and 11, a pair of alignment pins 56 extend downwardly from the first interior connection interface 44 of the top component 40. The alignment pins 56 are preferably integrally formed with the top component 40 and are arranged to engage the alignment bores 34 formed in the first interior connection interface 18 of the bottom component 14. The top component 40 and bottom component 14 are assembled by overlapping the first interior connection interfaces 18, 44 and the second interior connection interfaces 28, 50, respectively. Once connected, the intake channels 30, 52 and exhaust channels 32, 54 align and form a continuous fluid flow path between the vacuum and pressure ports 25, 27 and the interior diaphragm chamber.

Figure 2:
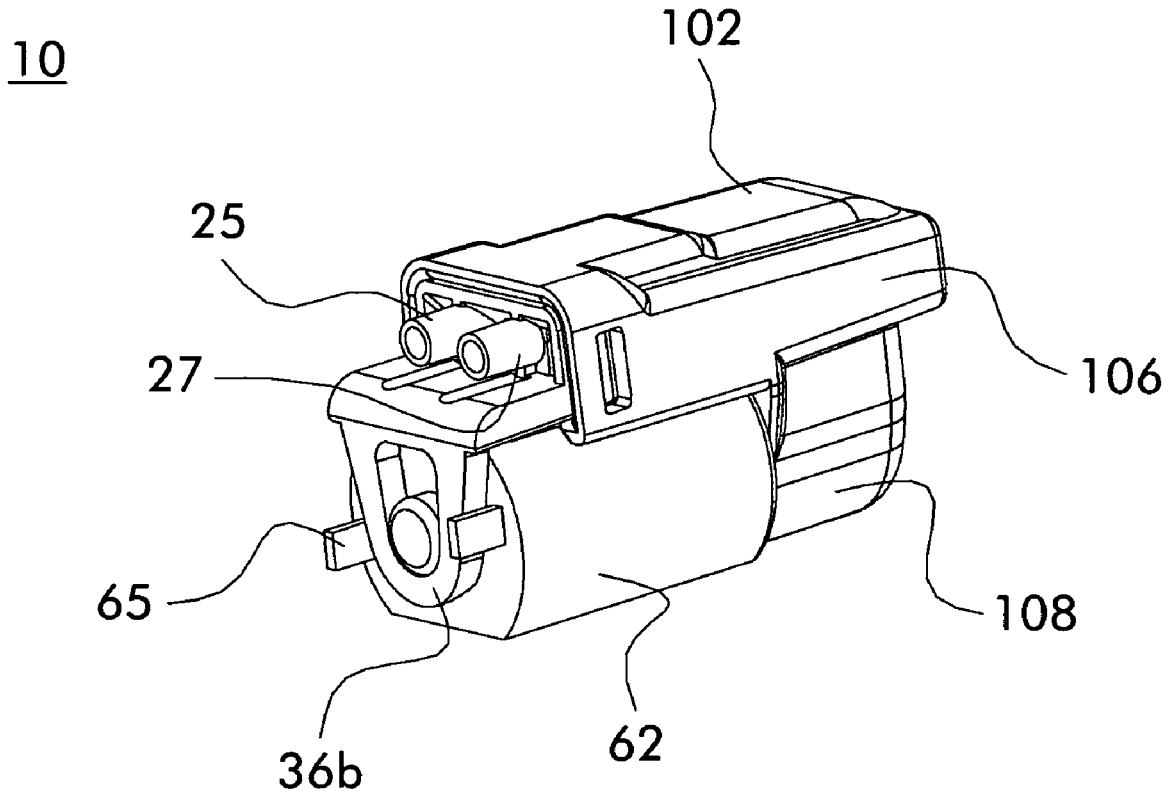
FIG. 2 is a second perspective view of the diaphragm pump shown in FIG. 1.

The pump 10 has a motor 60 removably mounted underneath the bottom component 14. Referring to FIGS. 3 and 4, the motor 60 is preferably a conventional, miniature D.C. motor having an exterior housing 62, a drive shaft 64, electrical leads 65, and shaft hubs 66*a*, 66*b* on each end of the housing 62. The motor 60 is mounted in U-shaped mounts 36*a*, 36*b* protruding downwardly from the bottom surface of the bottom component 14. The U-shaped mounts 36*a*, 36*b* are spaced so that the mounts 36*a*, 36*b* straddle the motor housing 62 with the shaft hubs 66*a*, 66*b* seated in the mounts 36*a*, 36*b* as best seen in FIGS. 2 and 5.

The interior piston assembly includes a piston 70, diaphragm 76, diaphragm cap 78, valve gasket 80, bearing assembly 82, and a counterbalanced eccentric pin 84 as shown in FIGS. 3 and 4. The piston 70 preferably includes a piston head 72 and piston arm 74, which are preferably formed as an integral unit. Two mounting posts 73 are formed with and extend transversely to the top surface of the piston head 72. An eyelet 87 is formed in the bottom of the piston arm 74.

The diaphragm 76 includes two apertures 77, which are arranged to align with the mounting posts 73 of the piston head 72. The diaphragm 76 is secured on the piston head 72 by the diaphragm cap 78, which engages the mounting posts 73. The piston assembly is self-locking and can be hand assembled by snapping the diaphragm cap 78 onto the mounting posts 73. The diaphragm 76 preferably has a rib portion 79 that extends around the periphery of the diaphragm 76. The rib portion 79 sits in the diaphragm seat 20 of the bottom component 14 and the diaphragm seat 45 of the top component 40. In one embodiment, the piston assembly linearly oscillates along an axis that is perpendicular to the lengthwise axis of the exterior pressure and vacuum ports. However, the pressure and vacuum ports may be oriented at a non-perpendicular angle relative to the axis of oscillation of the piston assembly.

The piston 70 and diaphragm cap 78 are preferably manufactured from an injection moldable material that is resistant to chemical attack such as polypropylene. The diaphragm 70 is preferably made from an elastomeric material that is resistant to chemical attack such as silicone, butyl, or ethylene propylene rubber (EPDM). More preferably, the diaphragm is made from butyl or EPDM.

To linearly oscillate the piston assembly, a counterbalanced eccentric pin 84 and bearing assembly 82 are installed on the motor drive shaft 64. The bearing assembly 82 is mounted in the eyelet 87 of the piston arm 74, while the eccentric pin 84 is mounted on the motor shaft 64. The eccentric pin 84, bearing assembly 82, piston arm 74 and drive shaft 64 are connected by interference fits. Therefore, the components of the piston assembly and bearing assembly are self-locking and can be assembled by hand by pressing the components together.

Figure 8:
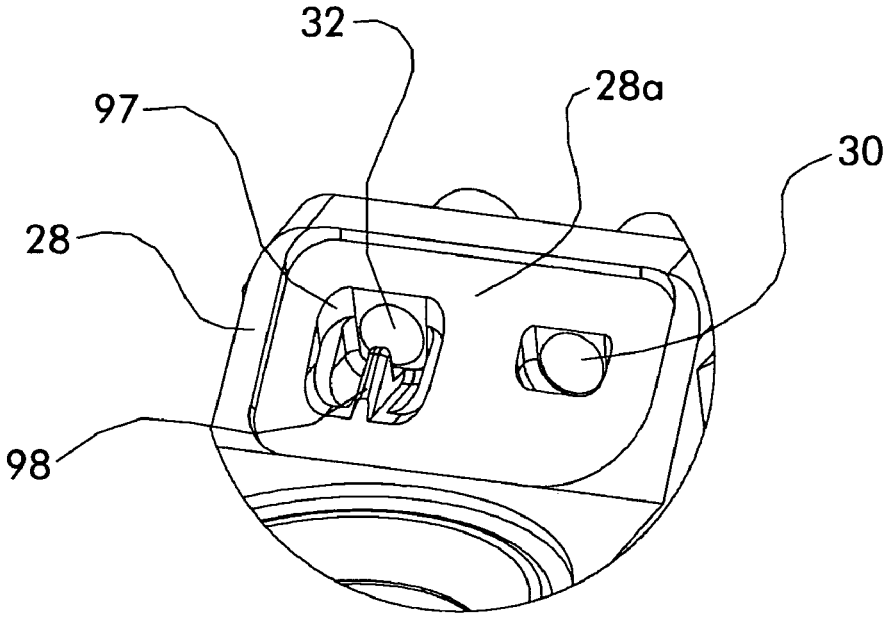
FIG. 8 is an enlarged perspective view of the second connection interface of the bottom component shown in FIG. 3.

A gasket 80 seals the interface between the second interior connection interfaces 28, 50 of the bottom component 14 and top component 40, respectively. Referring to FIG. 8, the second interior connection interface 28 of the bottom component 14 has a recessed portion 28*a* in which the gasket 80 is seated.

Figure 9:
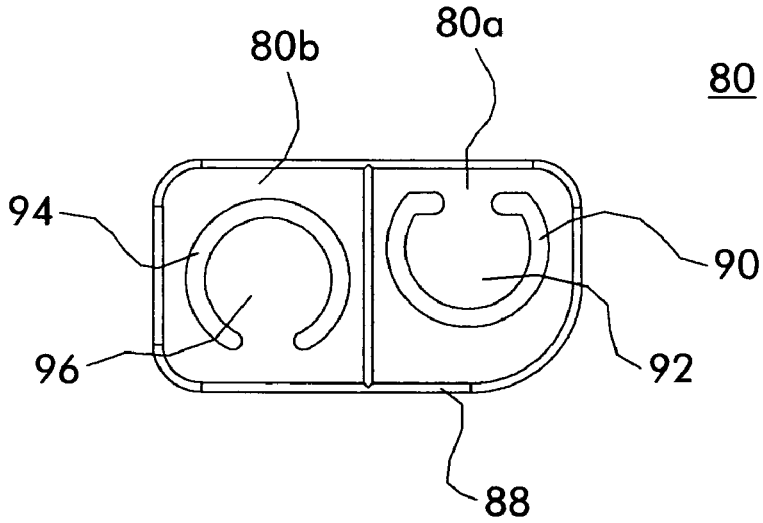
FIG. 9 is an enlarged, top plan view of the valve gasket shown in FIG. 3.

Referring to FIG. 9, the gasket 80 comprises a flat, generally-rectangular elastomeric material having a rib portion 88 that extends around the periphery of the gasket 80. The rib 88 also bifurcates the gasket 80 to isolate the intake side 80*a* from the exhaust side 80*b*. A horseshoe-shaped perforation 90 forms an intake flap 92 on the intake side 80*a* of the gasket 80. Similarly, a semi-circular perforation 94 forms an exhaust flap 96 on the exhaust side 80*b* of the gasket 80.

Referring to FIG. 8, an enlarged pocket 97 is formed in the second interface 28 of the bottom component proximate the exhaust channel 32. A septum 98 is formed intermediate the pocket 97. The septum 98 limits the path of travel of the exhaust flap 96 within the pocket 97. Similarly, referring to FIGS. 10 and 11, an enlarged pocket 95 is formed in the second interface 50 in the top component proximate the intake channel 52. A septum 99 is formed intermediate the pocket 95. The septum limits the path of travel of the intake flap 92 within the pocket 95.

Figure 12:
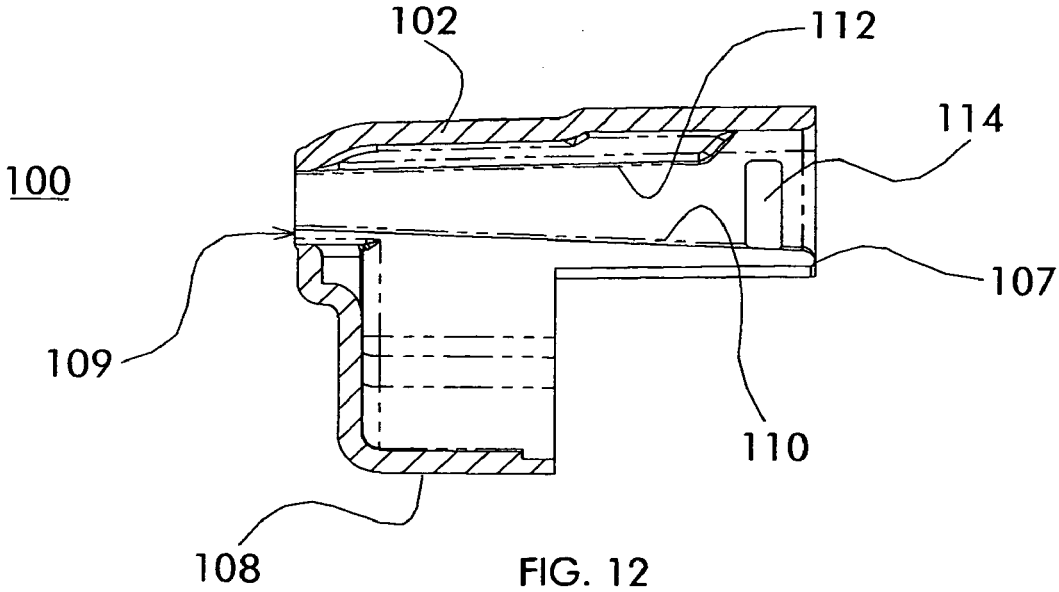
FIG. 12 is a cross-sectional view of the cover taken along the axis L-L of FIG. 4.

In a preferred embodiment, a cover 100 locks the top component 40 to the bottom component 14 and also reduces the amount of noise emitted by the pump 10. As best seen in FIG. 4, the cover 100 has an irregular shape that is symmetrical along a lengthwise axis "L". The cover 100 has a top wall 102, opposed side walls 104, 106, a bottom wall 108, rear end 107 and a front end 109. Referring to FIG. 12, the cover 100 has a pair of lengthwise-extending, inwardly-protruding edges 110, 112 formed on the inner surface of each side wall 104, 106.

In a preferred embodiment, the edges 110, 112 are skew. The first edge 110 is arranged to engage the underside of the lengthwise-extending edge of the bottom component 14. The second edge 112 is arranged to engage the upper side of the lengthwise-extending edge of the top component 40. The lengthwise-extending axes of the first 110 and second 112 edges are oblique and arranged such that the axes converge extending from the rear end 107 to the front end 109 of the cover 100. The taper of the axes of the edges 110, 112 is arranged to generally compliment the tapered angular orientation of the lengthwise-extending edges of the top and bottom components 40,14 and to compress the lengthwise-extending edges when the cover 100 is installed. The cover 100 creates a compressive force on both connection interfaces of the top 40 and bottom 14 components.

Each side portion 104, 106 of the cover 100 has a rectangular aperture 114 proximate the rear end 107. The aperture 114 is sized and arranged to engage the detent 38 formed on each of the side surfaces 26*a*, 26*b* of the bottom component 14, and to lock the cover 100 the bottom component 14.

The components of the pump 10 are designed to be quickly hand assembled, without the use of extraneous fasteners or adhesives since the components are self-locking. The components either snap-lock together or are press fit together by hand.

In a preferred embodiment of the invention, the motor 60 is initially installed on the bottom component 14. Referring to FIG. 5, the motor 60 is installed by inserting the drive shaft 64 at an angle through the front mount 36*a* until the front shaft hub 66*a* is seated in the front mount 36*a*. The back end of the motor 60 is then pushed upwardly while simultaneously deflecting the back mount 36*b* until the rear shaft hub 66*b* is seated in the back mount 36*b*.

Next, the piston 70, bearing assembly 82 and counterbalanced eccentric pin 84 are connected to the drive shaft 64 of the motor. In one embodiment, the bearing assembly 82 is press fitted into the eyelet 87 of the piston arm 74. The eccentric pin 84 is then press fitted into the bearing 82 and then press fitted onto the drive shaft 64.

With the piston head 72 extending through the interior cavity 22, the diaphragm 76 is secured to the piston head 72 by press fitting the diaphragm cap 78 to the mounting posts 73. The valve gasket 80 is placed in the recess 28*a* on the second interior connection interface 28 of the bottom component 14.

Figure 6:
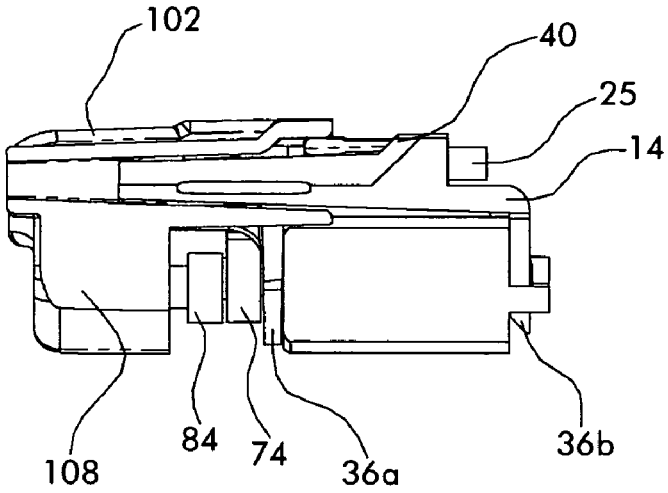
FIGS. 6 and 7 are side elevational views of the cover (partially revealed) being installed over the top and bottom components of the diaphragm pump shown in FIG. 1.
Figure 7:
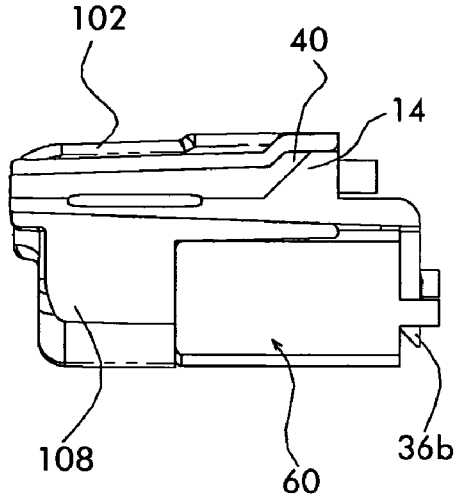

Once the interior components are assembled, the top 40 and bottom 14 components are aligned and locked to one another. The top component 40 is aligned with the bottom component 14 by inserting the alignment posts 56 of the top component 40 in the alignment bores 34 of the bottom component 14. Referring to FIGS. 6 and 7, the cover 100 is then slid over both components until the detents 38 on the bottom component 14 snap into the slots 114 in the side of the cover 100. The interior edges 110, 112 of the cover 100 engage and compress the exterior, lengthwise-extending edges of the top 40 and bottom 14 components to clamp the top and bottom components together. The cover compresses the first and second connection interfaces of the top 40 and bottom 14 components, respectively.

Figure 15:
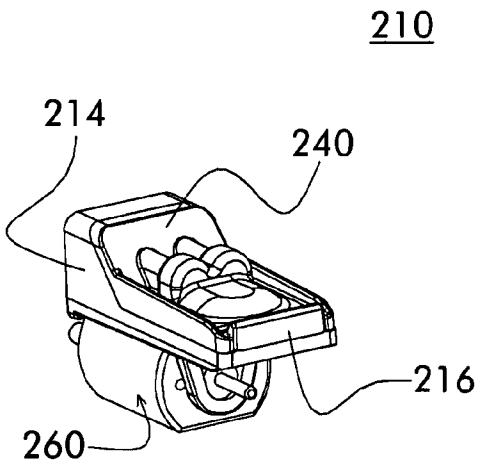
FIGS. 13-15 are perspective views of a diaphragm pump in accordance with another embodiment of the invention.
Figure 14:
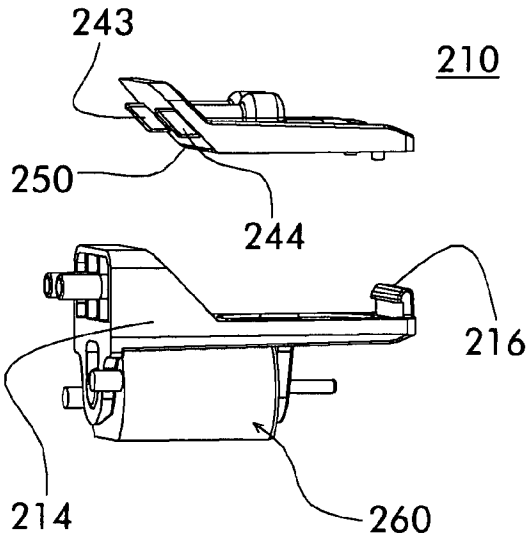
Figure 13:
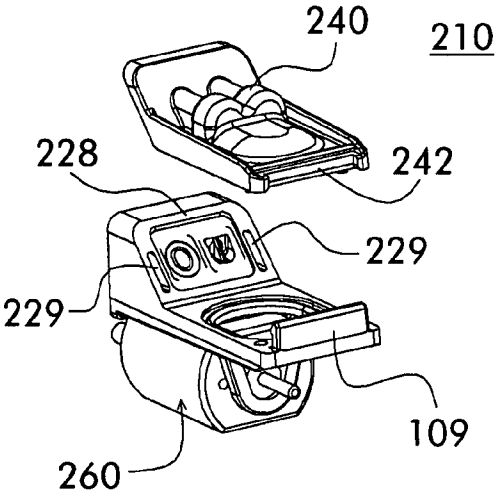

An alternative embodiment of the diaphragm pump, designated by reference numeral 210, is shown in FIGS. 13-15. The diaphragm pump 210 is similar in construction to the pump 10 described and illustrated above with the exception that the top and bottom components 240,214 are self-locking and do not require a separate locking element, such as the cover 100 described above. For clarity, the components of the piston assembly are omitted from FIGS. 13-15.

The pump 210 includes a top component 240 and bottom component 214 similar in construction, except as described below, to the top and bottom components 40,14 described above. The pump 210, however, does not include a cover for connecting the top and bottom components 240,214 together. Rather, snap locks are integrally formed on the top and bottom components 240,214 so that the top and bottom components can be snap-locked together and hand assembled.

Referring to FIGS. 13 and 14, the front end of the bottom component 214 includes a nose clip 216 that engages the nose 242 of the top component. Referring to FIG. 14, the top component 240 includes a pair of opposed tabs 243 fixed to and extending from the second connection interface 250. Referring to FIG. 13, the bottom component 214 includes a pair of opposed slots 229 formed in the second connection interface 228. The top and bottom components 240,214 are connected by inserting the nose 242 into the nose clip 216, and then pivoting the top component 240 about the nose 242 until the tabs 243 on the top component 240 snap-lock into the slots 229 in the bottom component 214.

Figure 16:
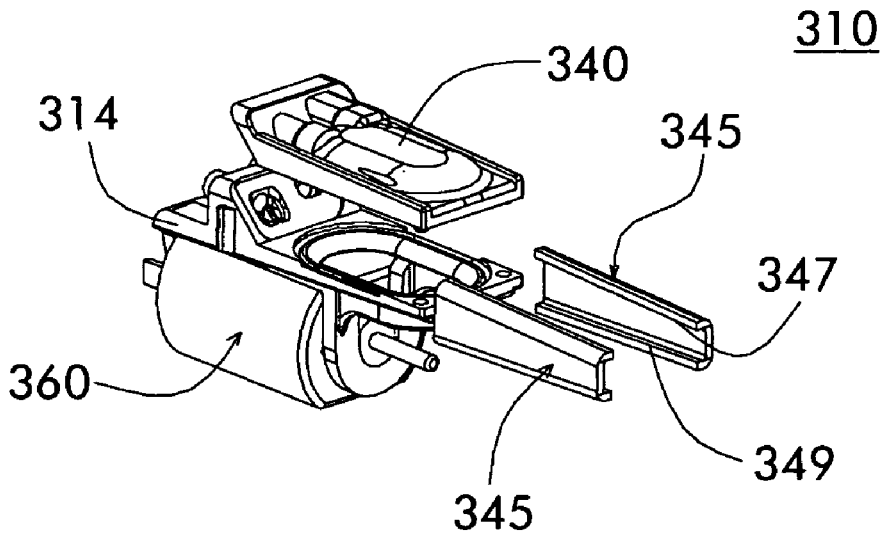
FIGS. 16 and 17 are perspective views of a diaphragm pump in accordance with a further embodiment of the invention.
Figure 17:
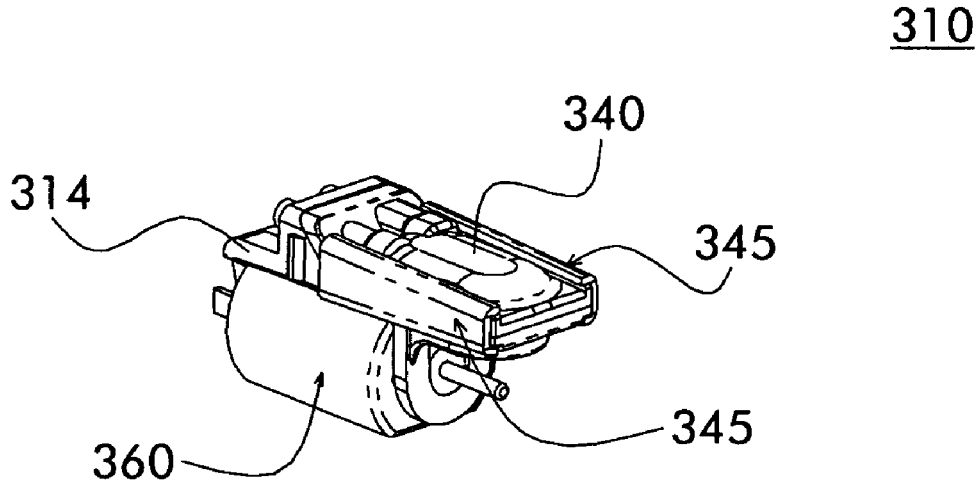

A further embodiment of the diaphragm pump, designated by reference numeral 310, is shown in FIGS. 16 and 17. The diaphragm pump 310 is similar in construction to the pump 10 described and illustrated above except that the cover 100 has been replaced with locking clips 345. For clarity, the components of the piston assembly are omitted from FIGS. 16 and 17.

The pump 310 includes a top component 340 and bottom component 314 similar in construction to the top and bottom components 40,14 described above. However, the pump 310 does not include a cover for connecting the top and bottom components 340,314 together. Rather, the top and bottom components 340,314 are locked together using two clips 345. The clips 345 compresses the first and second connection interfaces of the top 40 and bottom 14 components, respectively.

Referring to FIG. 15, the clips 345 are constructed similar to the lengthwise-extending, inwardly protruding edges 110, 112 of the cover 100 described above. The tapered angular orientation of the upper and lower interior edges 347,349 of the clips 345 are skew, and are arranged to generally compliment the taper of the lengthwise-extending edges of the top and bottom components 240,214, and to compress the lengthwise-extending edges when the clips 345 are installed. The top and bottom components 340,314 are connected by overlapping the top and bottom components 340,314, and then sliding the clips from front to back along the lengthwise-extending edges until the top and bottom components 340,314 are firmly compressed together.

Figure 18:
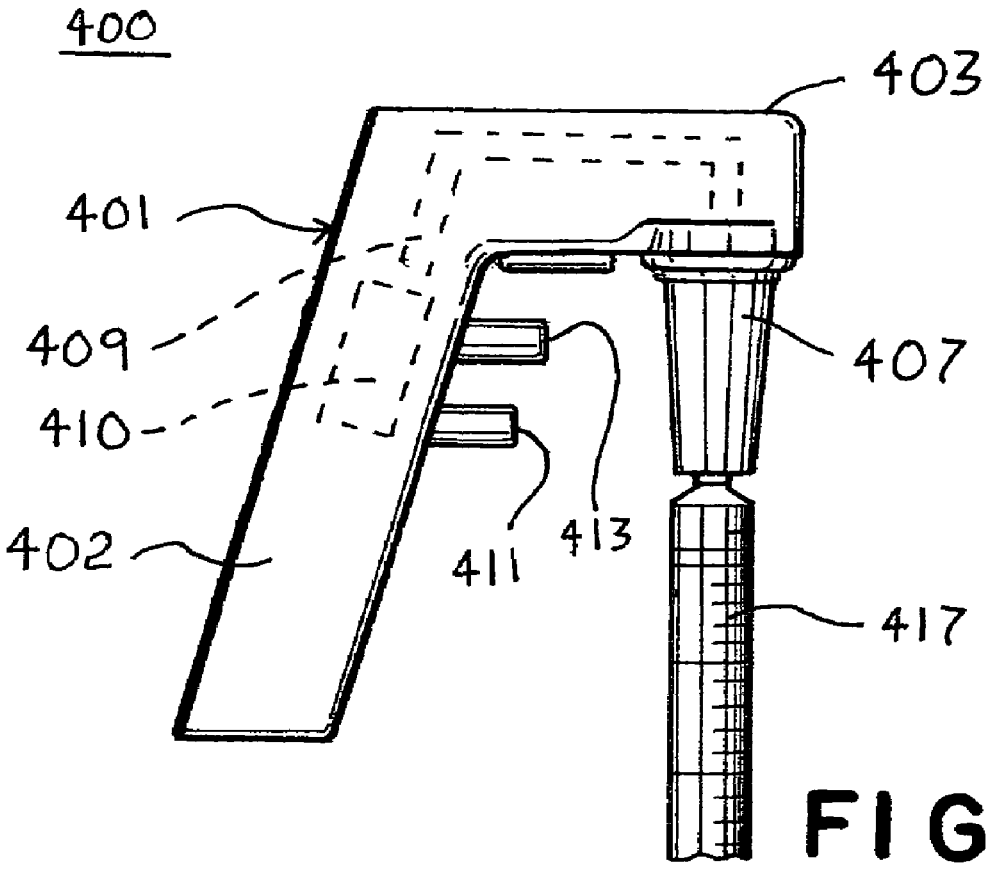
FIG. 18 is a schematic view of a pipette gun having a diaphragm pump in accordance with an embodiment of the invention.

In another embodiment of the invention, a diaphragm pump 410 is provided in a pipette gun 400 for admitting and emitting fluid from a pipette 417. Referring to FIG. 18, the housing 401 of the pipette gun 400 has a hand grip portion 402 and a barrel portion 403 that is oriented transverse to said hand grip portion. A pipette connector 407 is fixed to and is oriented transverse to the end of the barrel portion 403.

A diaphragm pump 410 is mounted inside the housing 401 of the pipette gun 400. The diaphragm pump may be any one of the embodiments of the pump described above. An internal conduit 409 connects the pump 410 to the pipette connector 407. A positive air flow trigger 411 and a negative air flow trigger 413 on the gun handle are connected to the pump 410 to selectively regulate the flow of either positive air pressure or negative air pressure through the pipette connector 407.

While the principles of the invention have been described above in connection with specific embodiments, it is to be clearly understood that this description is made only by way of example and not as a limitation on the scope of the invention.

The invention claimed is:

1. A diaphragm pump housing, comprising:

a) a first component and a second component, each component having first and second connection interfaces that are inclined relative to one another;

b) an interior pump chamber;

c) an exterior pressure port and an exterior vacuum port;

d) interior fluid communication channels extending through each component, said channels aligning with one another on at least one of said interfaces and connecting said exterior ports with said interior chamber when said first and second components are connected; and, e) means for locking said first component to said second component with said first and second connection interfaces in overlapping contact with one another.

2. The housing recited in claim 1, wherein said first and second components and said locking means can be hand assembled.

3. The housing recited in claim 2, wherein said locking means comprises a cover that encapsulates at least a portion of each of said first and second components.

4. The housing recited in claim 2, wherein said locking means comprises clips that clamp said first and second components together.

5. The housing recited in claim 1, wherein said locking means is integrally formed on at least one of said first and second components so that said components are self-locking and can be hand assembled.

6. The housing recited in claim 1, wherein each of said first and second components has a plurality of exterior surfaces that form the exterior surface of said housing.

7. The housing recited in claim 6, wherein said first component includes a base, a valve block formed on one end of said base, and a first connection interface and diaphragm seat formed at the other end of said base.

8. The housing recited in claim 7, wherein said valve block includes opposed exterior side surfaces, an exterior rear surface, and a second interior connection interface.

9. The housing recited in claim 8, wherein said pressure and vacuum ports are formed on said exterior rear surface of said valve block.

10. The housing recited in claim 9, wherein said valve block includes pressure and vacuum channels extending from said pressure port and vacuum port, respectively, to said second connection interface.

11. The housing recited in claim 10, wherein said second component has a base, an interior cavity and a first connection interface formed at one end of said base, and a valve head formed at the other end of said base.

12. The housing recited in claim 11, wherein said valve head includes a second connection interface, and pressure and vacuum channels extending through said valve block from said second connection interface to said interior cavity.

13. The housing recited in claim 12, wherein said pressure and vacuum channels of said first and second components align and form said fluid communication channels when said first and second components are assembled.

14. The housing recited in claim 1, wherein said first and second connection interfaces of said first component are oriented at an obtuse angle.

15. The housing recited in claim 1, wherein said first and second connection interfaces of said second component are arranged at an angle greater than 180 degrees.

16. The housing recited in claim 1, wherein said first component includes a mount adapted to connect a pump motor to said first component.

17. The housing recited in claim 16, wherein said pump motor mount is integrally formed with said first component.

18. The housing recited in claim 3, wherein said cover slidably engages and clamps together said first and second components.

19. The housing recited in claim 18, wherein said cover has opposed, interior, edges that engage the exterior surfaces of said first and second component.

20. The housing recited in claim 19, wherein said edges comprise tapered grooves on the interior of said cover and the exterior surfaces of said first and second components include elongate exterior edges that engage said tapered grooves.

21. The housing recited in claim 3, wherein said cover includes a snap-lock that engages said first component.

22. The housing recited in claim 21, wherein said snap lock comprises a detent protruding from an exterior side surface of said first component and a notch in said cover.

23. A diaphragm pump that can be assembled by hand, comprising:

a) a housing including: a first and a second housing component, each component having first and second connection interfaces; an interior pump chamber; an exterior pressure port; an exterior vacuum port; and, fluid communication channels extending through each component, said channels aligning with one another on at least one of said interfaces and connecting said exterior ports with said interior chamber when said first and second components are connected;

b) means for locking said first component to said second component with said first connection interfaces and said second connection interior interfaces in overlapping contact with one another;

c) a motor being mounted on one of said housing components; and, d) a linearly oscillating diaphragm arranged inside said housing and being driven by said motor.

24. The diaphragm pump recited in claim 23, wherein said first and second components and said locking means are self-locking.

25. The diaphragm pump recited in claim 24, wherein said locking means comprises a cover that slidably engages and clamps together said first and second components, and encapsulates at least a portion of said first and second components.

26. The diaphragm pump recited in claim 25, wherein said cover has opposed, tapered grooves on the interior of said cover, and the exterior surfaces of said first and second components include elongate exterior edges that engage said tapered grooves.

27. The diaphragm pump recited in claim 26, wherein said cover includes a snap-lock that engages said first component.

28. The diaphragm pump recited in claim 27, wherein said snap lock comprises a detent protruding from an exterior side surface of said first component and a notch in said cover.

29. The diaphragm pump recited in claim 24, wherein said locking means comprises clips that clamp said first and second components together.

30. The diaphragm pump recited in claim 23, wherein said locking means is integrally formed on at least one of said first and second components so that said components are self-locking.

31. The housing recited in claim 23, wherein said first and second connection interfaces are inclined relative to one another.

32. The housing recited in claim 23, including a self-locking motor mount on said first component for self-locking said motor to said housing.

33. The housing recited in claim 32, wherein said self-locking mount comprises a pair of elastically-deformable, U-shaped mounts integrally formed on said first component.

34. A diaphragm pump that can be assembled by hand, comprising:

a) a housing consisting of first and second housing components that form: an interior chamber in which a diaphragm linearly oscillates along a first axis; exterior pressure and vacuum ports having lengthwise-extending axes that are perpendicular to said first axis; and, interior fluid communication channels connecting said exterior ports with said interior chamber;

b) a motor mounted on said housing; and;

c) a linearly oscillating diaphragm arranged in said interior chamber and driven by said motor.

35. The diaphragm pump recited in claim 34, wherein said housing components are self-locking housing components.

36. The diaphragm pump recited in claim 35, wherein each housing component has first and second connection interfaces that overlap when said components are connected.

37. The diaphragm pump recited in claim 36, wherein said first and second connection interfaces of each housing component are inclined relative to one another.

38. The diaphragm pump recited in claim 34, wherein said housing further consists of means for locking said components together.

39. The diaphragm pump recited in claim 38, wherein each housing component has first and second connection interfaces that overlap when said components are connected.

40. The diaphragm pump recited in claim 39, wherein said first and second connection interfaces of each housing component are inclined relative to one another.

41. A diaphragm pump that can be assembled by hand, comprising:

a) a housing consisting of first and second, housing components that form: an interior chamber in which an elastic diaphragm oscillates; exterior pressure and vacuum ports; and, interior fluid communication channels connecting said exterior ports with said interior chamber;

b) a linearly oscillating diaphragm in said interior chamber; and, c) a diaphragm drive motor.

42. The diaphragm pump recited in claim 41, wherein said housing components are self-locking.

43. The diaphragm pump recited in claim 42, including a self-locking motor mount on said first component for self-locking said motor to said housing.

44. A diaphragm pump housing, comprising:

a) a first component and a second component, each component having first and second connection interfaces tat are inclined relative to one another;

b) an interior pump chamber;

c) an exterior pressure port and an exterior vacuum port;

d) interior fluid communication channels connecting said exterior ports with said interior chamber; and, e) means for locking said first component to said second component with said first and second connection interfaces in overlapping contact with one another;

wherein said first and second components and said locking means can be hand assembled, and wherein said locking means comprises a cover that encapsulates at least a portion of each of said first and second components.

45. The housing recited in claim 44, wherein said cover slidably engages and clamps together said first and second components.

46. The housing recited in claim 45, wherein said cover has opposed, interior, edges that engage the exterior surfaces of said first and second component.

47. The housing recited in claim 46, wherein said edges comprise tapered grooves on the interior of said cover and the exterior surfaces of said first and second components include elongate exterior edges that engage said tapered grooves.

48. The housing recited in claim 44, wherein said cover includes a snap-lock that engages said first component.

49. The housing recited in claim 48, wherein said snap lock comprises a detent protruding from an exterior side surface of said first component and a notch in said cover.

50. The housing recited in claim 44, including a self-locking motor mount on said first component for self locking said motor to said housing.

51. The housing recited in 50. wherein said self-locking mount comprises a pair of elastically-deformable, U-shaped mounts integrally formed on said first component.

52. A diaphragm pump housing, comprising:

a) a first component and a second component each component having first and second connection interfaces that are inclined relative to one another;

b) an interior pump chamber;

c) an exterior pressure port and an exterior vacuum port;

d) interior fluid communication channels connecting said exterior ports with said interior chamber; and, e) means for locking said first component to said second component with said first and second connection interfaces in overlapping contact with one another;

wherein said first and second components and said locking means can be hand assembled, and wherein said locking means comprises clips that clamp said first and second components together.

53. A diaphragm pump housing, comprising:

a) a first component and a second component, each component having first and second connection interfaces that are inclined relative to one another;

b) an interior pump chamber;

c) an exterior pressure port and an exterior vacuum port;

d) interior fluid communication channels connecting said exterior ports with said interior chamber; and, e) means for locking said first component to said second component with said first and second connection interfaces in overlapping contact with one another;

wherein said locking means is integrally formed on at least one of said first and second components so that said components are self-locking and can be hand assembled.

54. A diaphragm pump housing, comprising:

a) a first component and a second component, each component having first and second connection interfaces that are inclined relative to one another;

b) an interior pump chamber;

c) an exterior pressure port and an exterior vacuum port;

d) interior fluid communication channels connecting said exterior ports with said interior chamber; and, e) means for locking said first component to said second component with said first and second connection interfaccs in overlapping contact with one another;

wherein each of said first and second components has a plurality of exterior surfaces that form the exterior surface of said housing.

55. The housing recited in claim 54, wherein said first component includes a base, a valve block formed on one end of said base, and a first connection interface and diaphragm seat formed at the other end of said base.

56. The housing recited in claim 55, wherein said valve block includes opposed exterior side surfaces, an exterior rear surface, and a second interior connection interface.

57. The housing recited in claim 56, wherein said pressure and vacuum ports are formed on said exterior rear surface of said valve block.

58. The housing recited in claim 57, wherein said valve block includes pressure and vacuum channels extending from said pressure port and vacuum port, respectively, to said second connection interface.

59. The housing recited in claim 58, wherein said second component has a base, an interior cavity and a first connection interface formed at one end of said base, and a valve head formed at the other end of said base.

60. The housing recited in claim 59, wherein said valve bead includes a second connection interface, and pressure and vacuum channels extending trough said valve block from said second connection interface to said interior cavity.

61. The housing recited in claim 60, wherein said pressure and vacuum channels of said first and second components align and form said fluid communication channels when said first and second components are assembled.

62. A diaphragm pump housing, comprising:

a) a first component and a second component, each component having first and second connection interfaces that are inclined relative to one another;

b) an interior pump chamber;

c) an exterior pressure port and an exterior vacuum port;

d) interior fluid communication channels connecting said exterior ports with said interior chamber; and, e) means for locking said first component to said second component with said first and second connection interfaces in overlapping contact with one another;

wherein said first component includes a mount adapted to connect a pump motor to said first component.

63. The housing recited in claim 62, wherein said pump motor mount is integrally formed with said first component.

* * * * *